United States Patent [19]

Marshall et al.

[11] Patent Number: 4,731,970

[45] Date of Patent: Mar. 22, 1988

[54] SHINGLED BUILDING PANEL

[75] Inventors: Thomas L. Marshall, Hollister; Otis M. Martin, San Jose, both of Calif.

[73] Assignee: Marshall Manufacturing, Inc., San Jose, Calif.

[21] Appl. No.: 925,328

[22] Filed: Oct. 31, 1986

[51] Int. Cl.[4] ..... E04D 1/00

[52] U.S. Cl. ..... 52/543; 52/551; 52/560

[58] Field of Search ..... 52/543, 519, 520, 540, 52/478, 557, 409, 551, 560, 419, 748

[56] References Cited

U.S. PATENT DOCUMENTS

| | | | |
|---|---|---|---|
| Re. 27,502 | 10/1972 | Martin . | |
| Re. 27,574 | 2/1973 | Kough et al. . | |
| 2,256,435 | 9/1941 | Kraus . | |
| 2,384,686 | 9/1945 | Kraus . | |
| 3,095,671 | 7/1963 | Fink et al. | 52/409 |
| 3,333,384 | 8/1967 | Brady . | |
| 3,546,843 | 12/1970 | Luebs . | |
| 3,626,651 | 12/1971 | Kough et al. . | |
| 3,640,044 | 2/1972 | Watts . | |
| 3,664,081 | 5/1972 | Martin et al. . | |
| 3,841,050 | 10/1974 | Martin . | |
| 3,844,082 | 10/1974 | Martin et al. . | |
| 3,875,715 | 4/1975 | Martin et al. . | |
| 3,919,822 | 11/1975 | Martin et al. . | |
| 4,015,392 | 4/1977 | Eaton . | |
| 4,194,335 | 3/1980 | Diamond . | |

*Primary Examiner*—James L. Ridgill, Jr.

*Attorney, Agent, or Firm*—Flehr, Hohbach, Test, Albritton & Herbert

[57] ABSTRACT

A shingled panel (10) for covering the exterior of structures is disclosed which includes a base sheet (11) having at least one, and preferably multiple courses (12, 25, 35) of shingles secured thereto. The lowest course (12) of shingles (13) are positioned over a water resistant membrane strip (17) having an opening (18) through which the shingles (13) are glued directly to the base sheet (11). Each higher course (25, 35) of shingles (26, 36) has a membrane strip (27, 37) thereunder which terminates short of the bottom of each shingle in that course so that glue bond (31, 41) between the lower portion of each shingle (36, 26) in that course (35, 25) and the shingles (26, 13) in the next lower course (25, 12) can be achieved. Side-to-side sealing of adjacent panels (10) is effected by the end shingles (22, 48, 56) in alternate courses of shingles extending beyond the edges (34, 42) of the panel, while the end shingles (14, 28, 49) in the same courses at the opposite ends similarly are laterally recessed from the edges (34, 42) of the panel (10). Moreover, laterally recessed end shingles (14, 28) have a thickness dimension greater than laterally protruding end shingles (22, 48, 56) to facilitate nesting of shingles from laterally adjacent panels in overlapped, side-by-side relation across the joint between adjacent panels.

21 Claims, 4 Drawing Figures

FIG _ 1
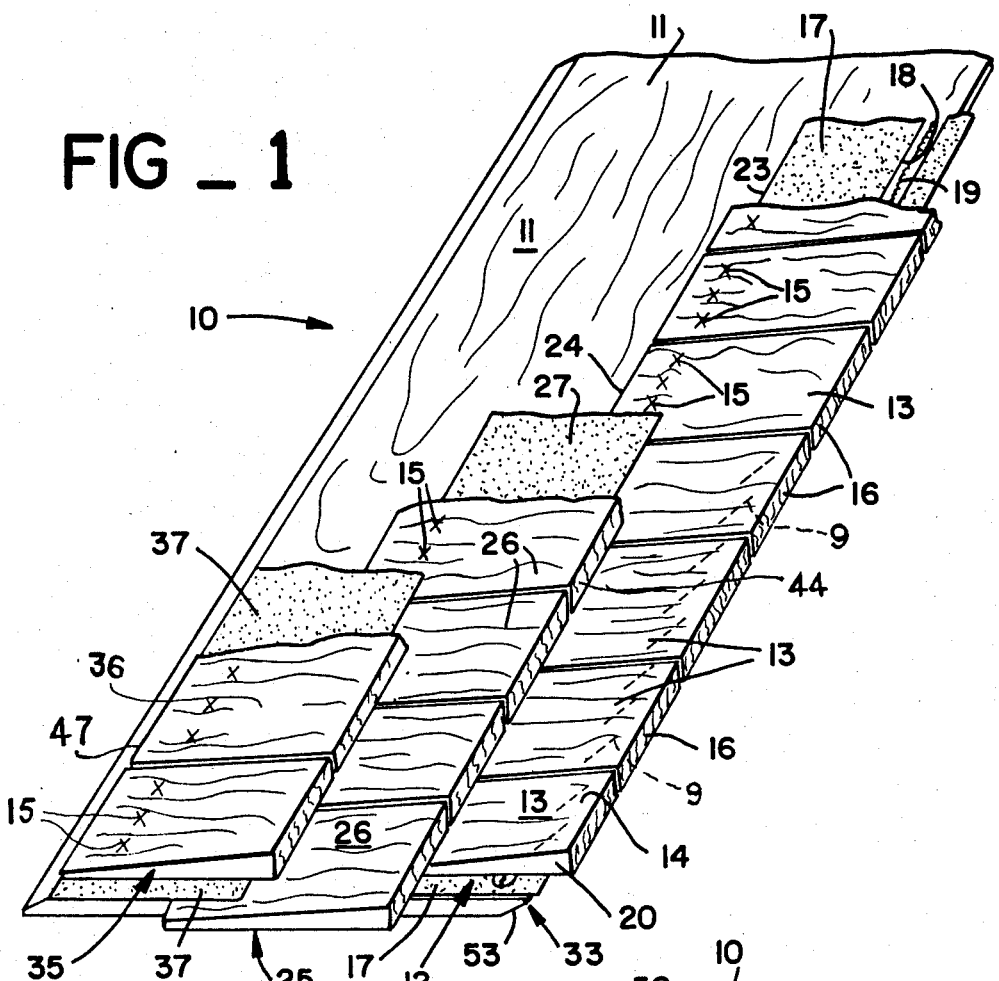
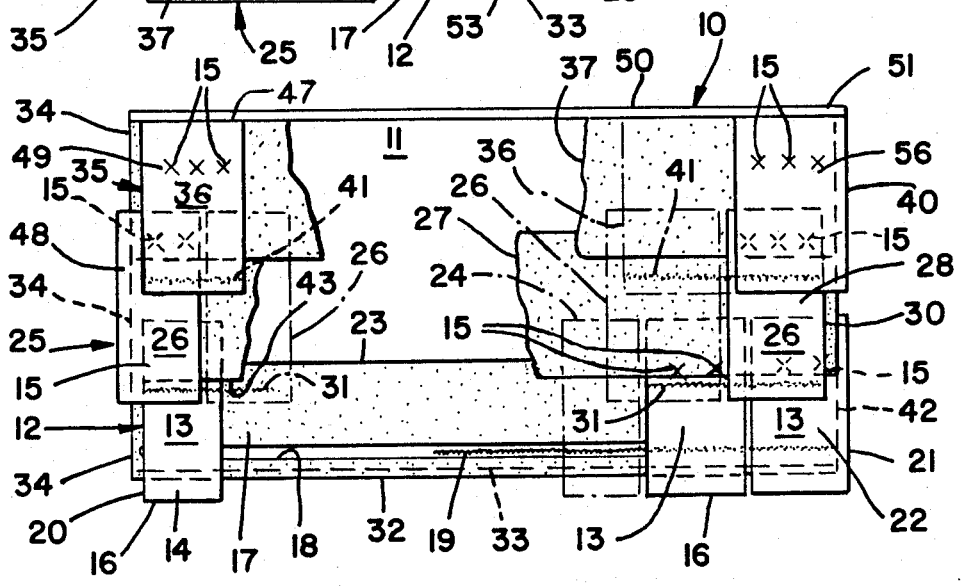
FIG _ 2

SHINGLED BUILDING PANEL

TECHNICAL FIELD

This invention is in the field of shingled panels useful to form the exterior of structures.

BACKGROUND ART

Shingles are frequently used for walls or roofs of structures. Wood shingles are attractive and they require little maintenance. Producing a shingled wall or roof by nailing individual shingles to sheathing is expensive because it consumes a great deal of time and because many shingles are broken during shipping and installation.

To reduce the cost of shingled structures and still preserve the advantages of shingles, prefabricated building panels having shingles mounted on a backing or base sheet have been made. A shingled wall, for example, can be made from a plurality of such panels by mounting the panels directly on a wall in side-to-side and top-to-bottom abutting relationships. The base sheet of the shingle panel may act as sheathing for the wall or roof, or the panel may be mounted over conventional sheathing. Known prefabricated building panel systems are typified by those disclosed in U.S. Pat. Nos. 2,384,686; 3,333,384; 3,546,843; 3,626,651; 3,664,081; 3,844,082; 3,875,715; 3,919,822; Re. 27,502; and Re. 27,574.

Various problems are associated with known prefabricated shingled panels. The panels must be mounted side-to-side and top-to-bottom without leakage between adjacent panels and without creating an appearance different from the random shingled appearance of a hand shingled wall. In prior art panels one way of dealing with these problems is by leaving open spaces at the edges of panels, the open spaces being even widths or even fractions of widths of shingles. The spaces are filled in by hand with shingles which are temporarily nailed to the panels and then permanently secured over the joint between panels adjacent after the panels are installed. This approach is disclosed, for example, in U.S. Pat. No. 3,841,050 and still requires some hand work. A similar approach is shown in U.S. Pat. No. 2,256,435.

Some prefabricated panels have end shingles that overlap laterally adjacent bases, e.g., U.S. Pat. Nos. 4,194,335; 4,015,392; and 3,640,044. However these panels have laterally staggered side edges or are difficult to assemble in the field, since they require sliding of adjacent shingles under one another which becomes particularly tedious as the number of courses of shingles per panel increases.

The cost competition between shingled panels in use in the industry has become intense. One system which is in wide spread use today employs sixteen inch kiln-dried cedar shingles which are cut in half to produce two eight inch long shingles and used to form a two-course shingled panel. This approach effects cost savings by enabling a single, sixteen inch shingle to be used to form a two-course panel.

While such two-course prior art panels have been economically manufactured, their field use has been found to have certain disadvantages. Such panels do not provide a joint along the vertical edges which is as aesthetically pleasing or functionally water-tight as would be preferred by most customers. Additionally, the number of panels required to form a square (one hundred square feet) of shingled area is undesirably large, requiring field personnel to spend additional time and cost manipulating and securing the panels to the wall or roof. Moreover, the manner in which the shingles are secured to the panel base requires the use of expensive kiln-dried shingles, and the cost of sixteen inch shingles, as compared for example to twelve inch shingles, is significant.

Accordingly, it is the objection to the present invention to provide a shingled building panel which can be easily assembled in the field by a single worker to produce a shingled structure having a surface which has the appearance and water-tight function of a hand-shingled structure.

Another object of the present invention is to provide a shingled building panel which can be used with similarly formed building panels to produce a shingled surface having greatly improved vertical and horizontal water-tight joints between the adjacent panels.

Another objection of the present invention is to provide a shingled building panel which can be constructed from air-dried shingles of moderate dimension, and therefore moderate cost, which panel also will retain its dimensional stability as the shingles dry further.

A further object of the present invention is to provide a shingled building panel in which the ease of field installation is greatly enhanced.

Still another object to the present invention is to provide a shingled building panel which can be easily constructed, is durable, requires fewer panels per square, and is of the size that can be manipulated easily.

The shingled building panel of the present invention has other objects and features of advantage which will become apparent from and are set forth in more detail in the accompanying drawing and the following description of the Best Mode For Carrying Out the Invention.

DISCLOSURE OF THE INVENTION

The panel of this invention includes a base member in the form of a sheet of material, such as plywood. The base member may perform the function of sheathing by being fastened directly to studs or rafters or it may be fastened to conventional sheathing. One face of the base is shingled, in accordance with the invention, with at least one and preferably three courses of shingles. The courses of shingles may be mounted on the base over specially positioned strips of waterproof membrane, e.g., roofing felt. The upper portion of each shingle is attached to the base with conventional fasteners, such as nails or staples driven from the front side of the panel, while the lower portion of each shingle is held in a wood-to-wood adhesive bond either directly to the base or directly to another shingle. Moreover, the lower portion or thicker butt ends of each shingle are backstapled to the base so that the combination stapled upper ends are glued and back-stapled lower ends firmly secures each shingle to the base over a waterproof membrane.

In each panel the end shingles in each course of shingles extend laterally beyond the side edge of the base at one end of the course and are recessed from the side edge at the other end of the same course. Moreover, alternate courses reverse the ends on which the end shingles protrude and are recessed. The vertical side edges of adjoining similarly formed panels, therefor, will mate with each other. Thus, the end shingles which alternately overlap and are recessed from the abutting side edges of the adjacent base members overlap the joint between the bases in a manner which maintains a random width shingle array that is aesthetically pleasing.

In preferred embodiment of the invention the end shingles which are recessed from the side edge of the base and also have a protruding end shingle in a course immediately above are thicker than the protruding end shingle at the opposite end of the same course. This facilitates the mounting of a laterally adjacent panel in side-by-side relation with the subject panel by enabling the sliding of the protruding end shingle of the adjacent panel underneath the overlapping end shingle of the course above in the subject panel.

In another preferred embodiment the upper and lower edges of each base sheet are formed to provide a weatherproof horizontally extending joint between adjacent panels, and to cause any water resulting from condensation on the base to flow from the interior surface of the panel toward the exterior surface of the wall.

BRIEF DESCRIPTION OF THE DRAWINGS

FIG. 1 is a top perspective view of a shingled panel constructed in accordance with this invention.

FIG. 2 is a top plan view, in reduced scale of the panel of FIG. 1.

BEST MODE FOR CARRYING OUT THE INVENTION

Figure 3:
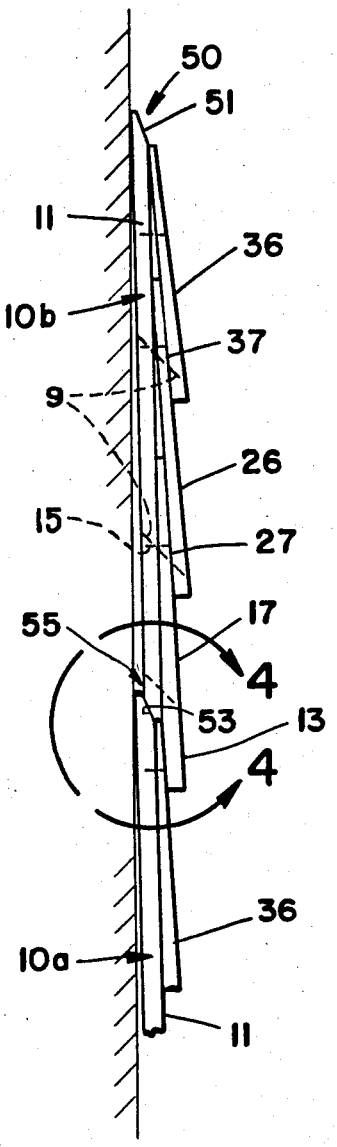
FIG. 3 is an end elevation view showing the relationship between two vertically adjacent panels.

FIGS. 1 and 2 of the drawings illustrate a panel embodying this invention. The panel is generally designated 10 and it consists of a sheet-like base 11 which is preferably made of plywood, particle board or other material that is weather resistent and adequate for sheathing. Panel 10 may be used as a wall or roofing panel, although it is particularly well-suited for use as an exterior siding panel in the formation of walls. For the purpose of convenience the positions of the various members will be described herein with the panel assumed to be in a vertical or at least inclined orientation.

In the illustrated embodiment base 11 has three courses of shingles attached to it. It is preferred that panel 10 be formed from wooden, and most preferably cedar shingles, but it will be understood that many of the advantages of the panel of the present invention will accrue if the shingles are formed from synthetic or non-wooden materials. The bottom or lowermost course 12 of shingles consists of shingles 13 which may be random widths.

In order to permit the use of lower cost shingles which are only air-dried (have not been kiln-dried), the panel of the present invention is formed so that the shingles are secured to base 11 in a manner insuring that the shingles are securely fixed to the base even after the shingles have dried completely. The upper portions or thin ends of shingles 13 are secured to the base 11 with suitable fastener means, such as galvanized eighteen gauge staples 15. Most preferably staples or first fastener means 15 are driven through the upper narrow portion of the shingles from the front or shingled side of panel 10.

Lowermost course 12 of shingles is mounted on base 11 so that the butt or lower shingle ends 16 protrude beyond the bottom edge 33 of base 11 so as to permit overlapping with the top course of shingles in a next lower, similarly-formed panel (not shown). For this purpose shingles 13 may extend beyond base 11 by about one and one-half inches.

To insure waterproof construction a water resistent membrane strip 17 is placed on base 11 beneath the bottom course of shingles 12. Strip 17 advantageously may be provided by conventional fiberglass-based roofing felt. Membrane strip 17 is positioned so that its upper edge 23 lies below the upper ends of shingles 13, and the lower edge 32 of strip 17 extends beyond the bottom edge 33 of base 11. Strip 17, however, extends beyond bottom edge 33 of base 11 a lesser distance than ends 16 shingles 13 extend beyond the base 11.

Membrane 17 is positioned on base 11 before shingles 13 are attached to it, and the positions of staples 15 preferably are such that they hold both shingles 13 and membrane 17 in place, i.e., they pass through the shingles and roofing felt and into base 11. Membrane strip 17 is provided with one or more transversely extending openings 18 which expose base 11 through them. The openings 18 are filled with adhesive 19 so that shingles 13 are glued directly to the base 11 by a bead of adhesive material, which extends over substantially the entire width dimension of each shingle.

Figure 4:
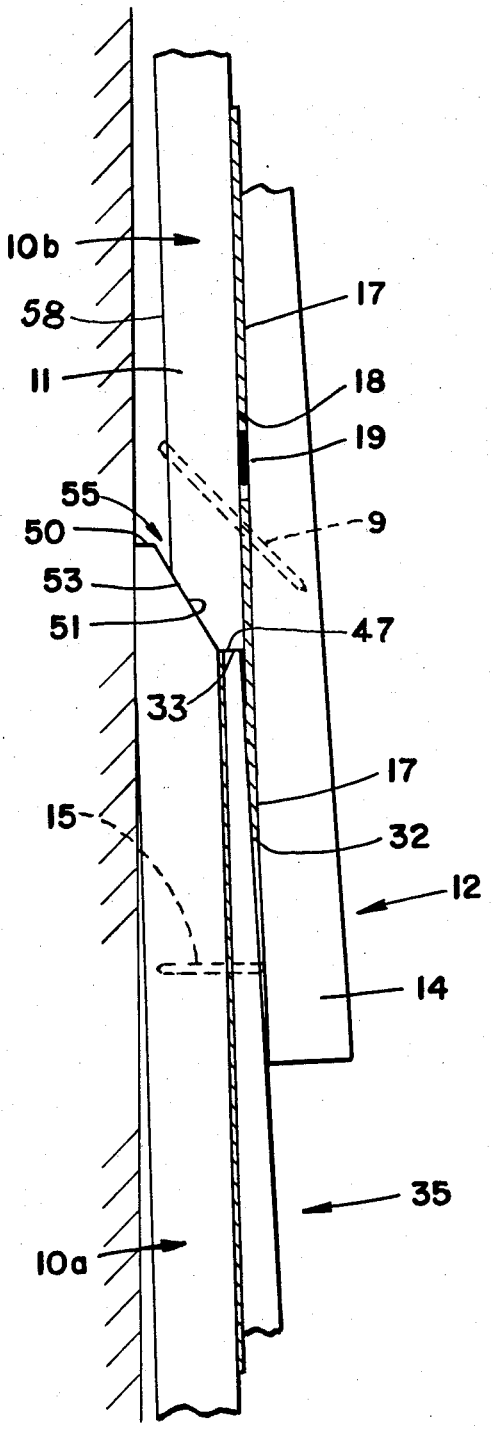
FIG. 4 is an enlarged view corresponding to the area 4—4 in FIG. 3.

In order to further secure shingles 13 to base 11, the shingles preferably are secured by second fastener means 9 driven through the back side of panel 10 and into the butt or thick ends of the shingles. Most preferably fasteners 9 are provided by staples which are driven into base 11 and shingles at an angle sloping toward the thick ends of the shingles (FIG. 4). This angular orientation of staples 9 tends to hold the shingles down against base 11, and it increases the length of staple 9 which is embedded in the shingle butt. Back-stapling of the panels is preferably accomplished after all the courses have been secured by staples 15 and adhesive beads, and it greatly augments staples 15, which only pass through a relatively narrow section of the shingles.

In this manner shingles 13 are held to base 11 both by their upper portion, through staples 15, and their lower portion, through the wood-to-wood adhesive connection and staples 9, thereby being fastened to base 11 with great stability.

Air-dried shingles may be used with this fastening structure since the transverse bead of adhesive will secure all vertically extending portions of the shingle. Thus, as the shingles dry further on the panel, any vertically extending cracks, for example as may be induced by drying or the holes at fasteners 9 and 15, will not result in shingle portions or fragments falling from the panel. Moreover, the roofing felt under the shingles will prevent water penetration through the panel in the event of shingle cracking during drying. Still further, wood-to-wood adhesion does not subject membrane strip 17 to any strain in holding the shingles to the base, and strip 17 will not be torn or abraded by any motion of shingles being subjected to strong winds, because the shingles are mounted to resist such motion.

The left edge 20 of a first end shingle 14 is laterally recessed or inset so that it does not extend to the left side edge 34 of base 11. The right edge 21 of the furthest right or second end shingle 22 in the same course 12 extends or protrude laterally beyond side edge 42 of base 11. The positioning of the left and right end shingles 14 and 22 on base 11 will produce a weather resistant structure to be described hereinafter.

Although the panel of the present invention can be formed with a single course of shingles, it is preferable to employ at least two courses and most preferably three courses of shingles. Thus, middle course 25 of shingles is composed of shingles 26 which overlap shingles 13 in the first course of shingles. Beneath the middle course of shingles 26 and overlapping upper ends 24 of shingles 13 is a water resistant membrane strip 27 which extends from a distance just short of the upper end of shingles 26 to a distance short of the bottom end of shingles 26. Shingles 26 also are fastened to base 11 through staples 15 which hold both shingles 26 as well as membrane strip 27 to base 11. Between the bottom edge 43 of membrane strip 27 and the bottom end 44 of the middle course of shingles, a bead of adhesive 31 is positioned on the upper surface of lower course shingles 13. Thus, each shingle in middle course 25 is held near its upper end by staples 15 and near its lower portion by a transversely extending, wood-to-wood, adhesive bonding to lower course 12 of shingles.

Additionally, as best may be seen in FIG. 3, second course of shingles 26 are preferably backstapled at about the same location as staples 15 in the first course of shingles. Thus, staples 9 securing the second course proximate the butt ends thereof also pass through the upper ends of shingles 13 in the first course to assist further in securing these shingles.

The membrane 27 overlaps the upper portion of each shingle in first course 12 enough to cover staples 15 holding them to base 11, and it overlaps the upper edge 23 of membrane strip 17 so that water running off of the middle course onto the lower course of shingles will drain from the panel without coming into contact directly with base 11 or the staples holding shingles 13 to base 11.

In the illustrated embodiment the panel 10 also includes a top or third course of shingles generally designated 35. The top course of shingles is comprised of shingles 36. The upper ends 47 of each shingle 36 are positioned closely adjacent to the upper edge 50 of base 11, and the shingles are fastened to base 11 by staples 15 over a water impervious membrane strip 37. The upper edge of strip 37 underlies the upper portion of each shingle 36, and the lower edge of membrane strip 37 extends to a position covering the staples holding the middle course shingles to base 11. The lower edge of strip 37 terminates short of the lower ends of each shingle 36 in course 35. Between the lower end of each shingle 36 and the lower edge of membrane strip 37 is a transversely extending bead of adhesive 41 which, again, provides a wood-to-wood bond between the shingles in upper course 35 and the shingles in middle course 25 of the panel. Back staples 9 extend through shingles 26 into the butt ends of shingles 36 to further secure the shingles in second course 25 and third course 35. The upper or third course of shingles and membrane strip 37 overlap middle course 25 of shingles and membrane strip 27 whereby drainage of water can take place from the upper course to the middle course without coming in contact with base 11 or fasteners 15 which hold the middle course to base 11.

A problem which has been encountered with prior building panels has been the formation of a joint at the vertical side edges of the panel which is aesthetically pleasing and an effective weather-resistent joint. Solutions which have here before been posed to this problem have also been somewhat tedious in their use in the field. Shingled building panel 10 of the present invention is formed with end shingles along the side edges of the base which are alternatively laterally recessed from and laterally extending or protruding beyond the side edges.

As best may be seen in FIG. 2, first end shingle 14 is laterally inset or recessed from side edge 34 of base 11. (It should be noted that roofing felt 17 extends completely to side edge 34.) At the opposite end of this first or lower course 12 of shingles a second end shingle 22 extends laterally beyond the opposite side edge 42 of base 11.

In the second course 25 of shingles, the end shingles of this course are reversed in their inset and extension with respect to the side edges of the base. Thus, third end shingle 48 extends or protrudes laterally beyond side edge 34 while fourth end shingle 28 at the right hand end of course 25 is recessed with respect to edge 42.

Similarly, in third course 35, fifth end shingle 49 is laterally recessed while sixth end shingle 56 extends laterally beyond the base.

A distance to which the end shingles in any course are laterally inset is preferably substantially equal to the distance to which the end shingle at the opposite end of the course extends beyond or protrudes from the side edge of the base. This structure allows side-by-side panels to mate with each other when placed in abutting relation so that a protruding second end corresponding to shingle 22 on a laterally adjacent panel (not shown) will overlap side edge 34 and abut against edge 20 of first end shingle 14. Similarly, the inset edge 30 of a shingle corresponding to shingle 28 in an adjacent panel will receive the protruding edge of shingle 48 in the second course. In the third course, the edge 40 will protrude into abutting relation with the edge of shingle 49 so as to extend beyond side edge 34 of the base. This provides overlapping of the shingles in laterally adjacent panels to produce a weather resistent joint and aesthetically pleasing joint. When assembled in side-by-side relation, panels of the present invention make it very difficult to determine the location of the vertical joints between panels.

While the lateral overlapping is highly advantageous in forming an aesthetic and weatherproof joint, such a structure, without more, can be very tedious to install in the field. Accordingly, the panel of the present invention is preferably further formed with those shingles which are laterally inset or recessed from the side edge of the panel and which have a course of shingles thereabove having a thickness dimension over the upper portion of the shingle (the portion which is overlapped by an upper course of shingles) which is greater than the thickness dimension over a similar length of the protruding end shingle at the opposite end of the same course.

More specifically, laterally recessed shingles 14 and 28 are both relatively thick shingles to thereby space the shingle in the course above them farther from base 11 than would be the case if these recessed shingles had the same thickness as the remaining shingles in the course. Thus, protruding shingles 48 and 56 are spaced from the base slightly more so that the height dimension between the lower ends of shingles 48 and 56 and the base is somewhat larger than what would otherwise be the case. This permits the protruding shingles of adjacent panels in the course below to slide underneath the shingles which are spaced at a greater distance by reason of the thicker shingles 14 and 28. The recessed shingle 49 normally is not formed as a thick shingle. Usually panels are assembled in side-by-side relation first across the structure. Thereafter the next vertically adjacent row of panels is installed. Thus, the shingle abutting side-by-side with shingle 49 does not have to be slid under an overlapping shingle from a panel above.

If one wants to assemble panels vertically before assembling the panels in side-by-side relation, then it would also be advantageious to provide shingle 49 as a thick shingle to space the shingle from the panel above for receipt of a shingle thereunder from a laterally adjacent panel.

Similarly, when a panel constructed in accordance with the present invention has only a single course of shingles, a thick, recessed, end shingle will space an overlapping and laterally protruding end shingle from a panel positioned above at a sufficiently great enough distance from the base to permit a similarly formed panel having a protruding end shingle to slide from the side underneath the overlapping shingle from the panel above.

As will be appreciated, it is possible to reverse which ends of the courses at which end shingles are recessed and at which end shingles protrude or extend beyond the side edges of the base. Thus, end shingles 14, 28 and 49 can protrude with end shingles 22, 48 and 56 being recessed. In such a structure, the recessed end shingles having a course above them preferably would be thicker.

One manner of insuring that the recessed shingles having a vertically adjacent course thereabove are thicker than the protruding shingle at the opposite end of the course is to use sixteen inch shingles for the thick shingles 14 and 28. The sixteen inch shingles can have their thin ends trimmed by four inches to produce a twelve inch long shingle which is similar in length to the other shingles in the course, but has a greater thickness dimension, particuarly over the length overlapped by the course above.

During field assembly the overlapping mating of the side edges of the shingled panels of the present invention greatly facilitates installation of the panels by a single workman. The workman can simply secure one panel to the framing at, for example, a lower right hand corner of the structure. It is a simple matter to slide a second panel into side-by-side abutment with edge 34 of the first panel. As the overlapping and recessed shingles slide together, they in effect secure one end of the second panel against falling away from the studs and allow the installer to manipulate the second panel from the other end. The second panel can then be nailed in position and subsequent panels added to the structure. As will be described in more detail hereinafter, vertical stacking also can be accomplished by a single installer, since the panels have a top and bottom edges which are formed to support the panels in the vertically stacked relation against framing.

Upper edge 50 and lower edge 33 of base 11 preferably are constructed to provide a shiplap joint between top-to-bottom abutting adjacent panels that is easy to assemble and is particularly resistent to water penetration between panels. As best shown in FIGS. 3 and 4, top edge 50 of each base sheet 11 is formed as an upwardly facing top shoulder 50 that is generally perpendicular to the surfaces of sheet-like base 11. Extending away from shoulder 50 is an outwardly facing beveled surface 51 that slopes from the interior face of sheet 11 toward the shingled face.

Bottom edge 33 of base 11 is formed with a similar shoulder and beveled construction, except that it has a bevel 53 in the reverse direction, namely, an inwardly facing direction. Thus, bottom edge 33 of each base 11 has a beveled surface 53 which runs from the unshingled face of base 11 toward the shoulder 33.

When installing panels of the present invention on framework to form a structure, panels will most preferably be installed by mounting a row of lower panels to the framing and thereafter mounting a row of higher panels to the framing. As shown in FIG. 4, lower panel **10*a* is mounted to a structure before the upper panel 10*b* is mounted thereto. With lower panel 10*a* in place, upper panel 10*b* slides into position so that its shoulder 33 abuts the top end 47 of shingles 36 in course 35 of the lower panel. The lower edge 33 of the upper panel 10*b*, therefore, is slightly offset from the upper edge 50 of the lower panel 10*a* to form a notch 55. The beveled faces 51 and 53** of the two bases are in surface-to-surface contact and slightly offset from one another.

When mounting upper panel **10*b* above lower panel 10*a*, panel 10*b* gravitates toward the position shown in FIG. 4 and reaches a stable position with respect to the lower panel so that nailing the upper panel to the studs of the structure is easily accomplished. In addition, the resulting shiplapped joint is inherently moisture resistent. Moreover, any water on the interior surface 58 of any panel 10*b* will drain down that interior surface into the notch 55, where it is captured and will tend to migrate along the beveled surface 51** toward the exterior of the structure for drainage or evaporation.

The panel of the present invention can advantageously be formed from shingles which are only twelve inches in length. Instead of using a kiln-dried sixteen inch shingle, therefore, the panel of the present invention is constructed from air-dried twelve inch long shingles. Twelve inch shingles of high quality can be formed with less breakage and product loss than can sixteen inch shingles. Accordingly, high grade twelve inch shingles are less expensive than similar sixteen inch shingles. While sixteen inch shingles can be cut in half to produce shingled panels found in the prior art, the cost savings effected by cutting them in half is lost as compared to the panel of the present invention by the requirement that the shingles be sixteen inches long and that they must be kiln-drying.

The panel of the present invention is preferably formed to be eight feet long with each course of shingles having approximately seven to eight inches of exposed shingle. The top course of shingles is formed by cutting the small ends of twelve inch shingles to between seven to eight inches in length (preferably 7½ inches). Seven panels having three courses of shingles with about a seven to eight inch shingle exposure per course and an eight foot length, therefore, will cover one square (one hundred square feet) as compared to almost eleven panels for a two course shingled panel of the type conventionally found in the marketplace.

The shingles are preferably bonded to the base or preceding course of shingles by a wood adhesive meeting APA Specification No. AFG-01, and GIBSON HOMANS SURE-STICK 96 is an example of a suitable wood adhesive. A five sixteenth's inch CDX exterior wood plywood may be used for the base, and various roofing felts are suitable for use with the panel of the present invention.

Although the drawings illustrate a building panel having three courses of shingles, the invention is applicable to building panels having one or more courses. Each vertically adjacent course should alternate between courses having the end shingles extending beyond the base and end shingle recessed or inset from the edge of the base. In panels having even numbers of courses of shingles, each panel may be made identical to each other panel. In panels having odd numbers of courses of shingles panels mounted directly above one another must have the protruding end shingles and recessed end shingles in vertically adjacent courses of shingles alternate. For example, in the embodiment of FIG. 2, the panel mounted above the pictured panel must have the end shingle of the bottom course of shingles extending beyond the left edge of its base 11. On the right side, the vertically adjacent panel must have the end shingle of the bottom course of shingle recessed from the right side of base 11. Subsequent vertically adjacent courses would alternate the ends at which shingles are laterally recessed or protrude.

What is claimed is:

1. In a shingled building panel including a sheet-like base having at least one course of side-by-side shingles extending across and secured to said base, the improvement comprising:

said shingles in a lowermost course on said base having ends extending below a lower edge of said base to overlap an upper edge of a similarly formed panel mounted in vertically abutting relation to said panel;

said lowermost course having end shingles at opposite ends of said base which are mounted to protrude laterally beyond and to be laterally recessed with respect to opposite side edges of said base by a distance which is about equal; and the laterally recessed end shingle having a thickness dimension over an upper portion thereof greater than the thickness dimension of the laterally protruding end shingle over the same upper portion whereby the thicker end shingle spaces any vertical adjacent course having an overlapping end shingle at a greater distance from said base than the thickness dimension of a protruding end shingle on a similarly formed panel placed in side-by-side abutting relation to said panel.

2. The shingled building panel as defined in claim 1 wherein, said panel includes at least two courses, with an upper course vertically overlapped over a portion of said lowermost course, and with an end shingle of said upper course protruding laterally beyond the side edge of said base on the side of said base having the laterally recessed end shingle in said lowermost course, and an end shingle in said upper course laterally recessed from the side edge of said base having the laterally protruding end shingle in said lowermost course.

3. The shingled building panel as defined in claim 2 wherein, said end shingles in any course protrude laterally beyond and are laterally recessed from said side edges by about the same distance.

4. The shingled building panel as defined in claim 2 wherein, said panel has three courses of shingles secured to said base with said end shingles in vertically alternating of said courses extending beyond and being recessed from said side edges at both side edges of said base, and said recessed end shingles having a vertically adjacent course thereabove having a greater thickness dimension than the laterally protruding shingles at the opposite end of the same course.

5. The shingled building panel as defined in claim 4 wherein, said shingles are formed of a wooden material having a length of about twelve inches in each course other than an uppermost course, said shingles in said uppermost course having a length between about seven to about eight inches and said shingles having approximately seven to eight inches visible in each course which is overlapped by a course above.

6. The shingled building panel as defined in claim 2 wherein, each of said courses has water impervious membrane means extending across said panel and mounted between said shingles and at least one of said base and a lower course of said shingles; and said membrane means is formed and shingles are secured to said base in part by an adhesive material extending substantially across the width dimension of each of said shingles and positioned in direct contact with both said shingles and at least one of said base and a lower course of shingles.

7. The shingled building panel as defined in claim 6 wherein, said membrane means is provided by a plurality of strips of roofing felt with:

a first of said strips mounted on said base under a lowermost of said courses, said first of said strips extending upwardly along said base less than the length of said shingles in said lowermost course;

a second of said strips overlapping the upper ends of said lowermost course of shingles and overlapping said first of said strips, and a second of said courses of shingles positioned over said second strip and extending down beyond said second strip to overlap said lowermost course of shingles.

8. The shingled building panel as defined in claim 7 wherein, first strip is formed with opening means therein, and said adhesive material is positioned in said opening means between said base and said shingles in said lowermost course.

9. The shingled building panel as defined in claim 8 wherein, said adhesive material is also positioned between said second of said courses and said lowermost course in the area beyond said second strip.

10. The shingled building panel as defined in claim 2 wherein, said base is formed with an upper edge having a beveled surface facing in an outward direction with respect to said panel; and said base is formed with a lower edge having a transverse shoulder means and a beveled surface facing in an inward direction with respect to said panel.

11. The shingled building panel as defined in claim 10 wherein, said courses of shingles include a lowermost course having shingles which extend downwardly beyond said lower edge and an uppermost course of shingles in which said shingles have transverse upper ends proximate the lower end of the outwardly facing beveled surface.

12. The shingled building panel as defined in claim 11 wherein, said panel includes a strip of roofing felt positioned between said lowermost course of shingles and said base and extending below said lower edge of said base and a strip of roofing felt positioned between said uppermost courses of shingles and said base and terminating proximate said outwardly facing beveled surface.

13. In a shingled building panel for use with other similarly formed panels to form a structure, said panel including a sheet-like base having upper and lower edges and opposite side edges, a first course of side-by-side shingles extending across said base between said side edges and secured to said base with lower ends of said shingles in said first course extending over said lower edge of said base, a second course of side-by-side shingles extending across said base between said side edges and secured to said base with lower ends of said shingles in said second course vertically overlapping the upper ends of said shingles in said first course, wherein the improvement in said shingled building panel comprises:

a first end shingle at one end of said first course laterally recessed with respect to one of said side edges of said base and a second end shingle at an opposite end of said first course extending laterally beyond the opposite side edge of said base, said first end shingle further having a thickness dimension greater than said second end shingle; and a third end shingle at one end of said second course of shingles extending laterally beyond said one of said side edges, and a fourth end shingle at an opposite end of said second course laterally recessed from said opposite side edge of said base whereby an adjacent similarly formed panel can be mounted in abutting side edge-to-side edge relation with said panel and a second end shingle of said adjacent panel and a third end shingle of said panel overlap the abutting side edges of the panels with the second end shingle of said adjacent panel positioned under said third end shingle of said panel.

14. The shingled building panel as defined in claim 13 wherein, said panel includes a third course of shingles mounted in overlapped relation with said second course of shingles, said third course of shingles having a fifth end shingle at an end of said third course recessed from said one of said side edges and a sixth end shingle at extending laterally beyond said opposite side edge, and said fourth end shingle is formed with a greater thickness dimension than said third end shingle along the length thereof overlapped by said third course of shingles.

15. The shingled building panel as defined in claim 14 wherein, said upper edge of said base is beveled in an outwardly facing direction, said lower edge of said base is formed with transversely extending shoulder means and is beveled in an inwardly facing direction, said first course of shingles extends below said lower edge, said third course of shingles terminates in upwardly facing shingle ends positioned proximate and below the outwardly facing beveled surface for support of a vertically adjacent similarly formed panel thereon with the outwardly facing beveled edge of said panel protruding inwardly of the back surface of the base of the vertically adjacent similarly formed panel, and each of said courses has a strip of roofing felt positioned thereunder and extending between said side edges with the roofing felt under said first course extending below said lower edge of said base, and the roofing felt under said second course overlapping said first course, and the roofing felt under said third course starting at said outwardly facing beveled surface and extending down to overlap, said second course of shingles.

16. A shingled building panel comprising a base having upper, lower, right and left edges, an upper course and lower course of shingles mounted to said base with each shingle in each course having upper, lower, right and left edges, fastening means holding an upper portion of each lower course shingle to said base with the lower edges of each lower course shingle extending beyond the lower edge of said base, a membrane strip between said base and said lower course shingles, said membrane strip having an opening therethrough near the lower edge of said base, adhesive in said opening with said adhesive in contact with each lower course shingle and with said base, and with the lower edge of said membrane extending beyond the lower edge of said base a distance less than the lower course of shingles extends beyond the lower edge of said base, fastening means holding an upper portion of each shingle of the upper course of shingles to said base with the lower edge of each upper course shingle extending beyond the fastening means of the lower course of shingles and with the upper edge of the upper course of shingles located adjacent the upper edge of said base, a membrane strip positioned between said upper course of shingles and the lower course of shingles, the upper edge of said membrane strip being substantially beneath the upper edge of said upper course of shingles and the lower edge of said membrane strip extending beyond the fastening means of the next lower course of shingles and extending downwardly a distance less than the lower edge of said upper course of shingles, the end shingle of one course of shingles extending beyond the right edge of said base and the opposite end shingle of said one course of shingles being recessed from the left end of the base, and the end shingle of a different course of shingles extending beyond the left edge of said base and the opposite end shingle of said different course of shingles being recessed from the right edge of the base.

17. The panel of claim 16 and, an intermediate course of shingles with fastening means holding an upper portion of each intermediate course shingle to said base, the lower edge of each intermediate course shingle extending beyond the fastening means holding the next lower course of shingles to said base, an intermediate membrane strip positioned between said intermediate course of shingles and the next lower course of shingles, the lower edge of said intermediate membrane extending beyond the fastening means holding the next lower course of shingles to said base and a distance less than the lower edges of said intermediate course of shingles, adhesive connecting the next lower course of shingles to said intermediate course of shingles at a position between the lower edge of the intermediate membrane strip and the lower edge of the shingles in said intermediate course of shingles, and with alternating courses of shingles extending beyond and recessed from the right edge of said base and offset alternating courses of shingles extending beyond and recessed from the left edge of said base.

18. The panel of claim 16 wherein, the end shingle that is recessed from the edge of said base and has an end shingle overlapping from an upper course of shingles is thicker than the end shingle that extends beyond the edge of said base in the same course of shingles.

19. In a shingled building panel having a sheet-like base, and at least one course of shingles extending across and secured to said base, and a water resistant membrane means positioned between said course of shingles and said base, the improvement comprising:

at least a plurality of said shingles each being secured to said base by:

(i) first fastener means extending from the shingled side of said panel through each shingle proximate a narrow end thereof into said base;

(ii) second fastener means extending from a back side of said panel through said base and into each shingle proximate a thick end thereof;

(iii) said membrane means being formed to and exposing an area beneath a portion of each of said shingles for direct face-to-face juxtaposition with areas of said base; and (iv) adhesive means positioned between said base and each of said shingles and adhesively bonding said area of each of said shingles directly to said areas of said base.

20. The shingled building panel as defined in claim 19, and said panel is formed with at least two courses of shingles with an upper course overlapping a lower course;

substantially all of said shingles are secured to said base with said first fastener means and said second fastener means; and said adhesive means is positioned under and adhesively directly bonds said area of each of said shingles in said lower course to said areas of said base, and adhesive means also is positioned between a portion of each of said shingles in said upper course and said shingles in said lower course and adhesively directly bonds said shingles in said upper course to said shingles in said lower course.

21. the shingled building panel as defined in claim 20, and said adhesive means is positioned proximate and under said thick end of said shingles in said lower course and said thick end of said shingles in said upper course;

said water resistant membrane means is positioned beneath said lower course and extends horizontally across said panel and extends vertically from a position above said first fastener means, which pass therethrough, down to a position above said area of each of said shingles bonded by said adhesive means to said areas of said base; and water resistant membrane means positioned between said upper course and said lower course and extending horizontally across said panel and extending vertically from a position above said first fastener means, which pass therethrough, down to a position above said adhesive means bonding said upper course to said lower course.

* * * * *